US006718992B1

(12) United States Patent
Cardola et al.

(10) Patent No.: US 6,718,992 B1
(45) Date of Patent: Apr. 13, 2004

(54) LIQUID NEUTRAL TO ALKALINE HARD-SURFACE CLEANING COMPOSITION

(76) Inventors: Sergio Cardola, Procter & Gamble Italia S.p.A., Rome Technical Centre, via della Maglianella 65/T, I-00166 Rome (IT); Panos Iakovides, Procter & Gamble Italia S.p.A., Rome Technical Centre, via della Maglianella 65/T, I-00166 Rome (IT); Laura Orlandini, Procter & Gamble Italia S.p.A., Rome Technical Centre, via della Maglianella 65/T, I-00166 Rome (IT); Maria Rosa Rescio, Procter & Gamble Italia S.p.A., Rome Technical Centre, via della Maglianella 65/T, I-00166 Rome (IT)

( * ) Notice: Subject to any disclaimer, the term of this patent is extended or adjusted under 35 U.S.C. 154(b) by 0 days.

(21) Appl. No.: 09/763,054

(22) PCT Filed: Aug. 24, 1999

(86) PCT No.: PCT/US99/19205

§ 371 (c)(1),
(2), (4) Date: Feb. 16, 2001

(87) PCT Pub. No.: WO00/12661

PCT Pub. Date: Mar. 9, 2000

(30) Foreign Application Priority Data

Aug. 27, 1998 (EP) ..... 98202864

(51) Int. Cl.[7] ..... B08B 3/04; C11D 1/72; C11D 3/22; C11D 3/37

(52) U.S. Cl. ..... 134/25.2; 134/38; 134/39; 134/40; 134/42; 510/238; 510/239; 510/240; 510/362; 510/365; 510/421; 510/435; 510/471; 510/475; 510/500

(58) Field of Search ..... 510/238, 239, 510/240, 362, 365, 421, 435, 471, 475, 500; 134/25.2, 38, 39, 40, 42

(56) References Cited

U.S. PATENT DOCUMENTS 3,970,594 A * 7/1976 Claybaugh ..... 252/524

FOREIGN PATENT DOCUMENTS

| | | | | |
|---|---|---|---|---|
| EP | 0 013 585 | | 7/1980 | |
| EP | 0 017 149 | | 10/1980 | |
| EP | 0 256 696 | | 2/1988 | |
| EP | 0 635 567 | | 1/1995 | |
| EP | 0 859 044 | | 8/1998 | |
| EP | 982394 | A1 * | 3/2000 | ..... C11D/3/37 |
| GB | 1340516 | * | 11/1970 | ..... C08B/21/26 |
| GB | 1340516 | * | 12/1973 | ..... C08B/21/26 |
| WO | WO 96 04358 | | 2/1996 | |
| WO | WO 00/12661 | * | 3/2000 | ..... C11D/3/37 |

OTHER PUBLICATIONS

"McCutcheon's vol. 1: Emulsifiers & Detergents", McCutcheon's Division, 1997, p. 202, no month given.*

* cited by examiner

*Primary Examiner*—Brian P. Mruk

(57) ABSTRACT

Neutral to basic compositions comprising surfactants other than amphoteric surfactants, copolymers of vinylpyrrolidone and an alkylenically unsaturated monomer, and a polysaccharide polymer. Also, employment of these compositions in processes for treating hard surfaces, providing a shine benefit to the hard surfaces, reducing limescale deposits and watermarks from hard surfaces, and for providing a "next-time" cleaning benefit to hard surfaces.

21 Claims, No Drawings

LIQUID NEUTRAL TO ALKALINE HARD-SURFACE CLEANING COMPOSITION

TECHNICAL FIELD

The present invention relates to liquid compositions for cleaning hard-surfaces.

BACKGROUND OF THE INVENTION

Liquid compositions for cleaning hard-surfaces have been disclosed in the art.

Liquid hard-surface cleaning compositions may be formulated in a variety of ways. Liquid hard-surface cleaning compositions, having a neutral to alkaline pH, comprising amongst other ingredients, a surfactant or a surfactant system both of which are well known in the art. Said compositions show good cleaning on a variety of soils and surfaces. However, consumers are looking for liquid cleaning compositions that would not only clean a hard-surface in a primary or 'first-time' cleaning operation but also render the hard-surface less prone to soil adherence and thus facilitating 'next-time' or secondary cleaning operation (i.e., a subsequent cleaning operation following a primary or 'first-time' cleaning operation).

Hard-surface cleaning compositions having a 'next-time' cleaning benefit are known in the art. Said compositions may comprise among other ingredients polymeric material, e.g., hard-surface cleaning compositions comprising a polyvinyl pyrrolidone (EP-A-0 635 567). The ability of said compositions to render a hard-surface treated therewith less prone to soil adherence is not yet satisfactory and may be further improved.

Thus, the object of the present invention is to formulate a liquid cleaning composition for removal of various soils from various hard-surfaces, e.g., hard-surfaces found in houses, having an improved 'next-time' cleaning benefit/performance compared to other hard-surface cleaners.

Furthermore, it is also desirable that such liquid hard-surface cleaning compositions should have the ability to provide good shine to the surfaces treated. However, surface shine is often compromised since when water comes into contact with hard-surfaces (e.g., in the rinse operation) it has the tendency to form droplets on the surface. The presence of droplets as compared to a thin film uniformly spread over the surface or running off the surface results in the loss of shine. Furthermore, as water evaporates from the droplets, poorly water soluble inorganic salts such as calcium/magnesium carbonate and/or phosphate salts precipitate with consequent formation of watermarks on the surface and, eventually limescale deposits, resulting in an unacceptable mark on the surface.

It is thus a further object of the present invention to improve the formation of a uniform thin film of water and to reduce the formation of watermarks and/or limescale deposits on a hard-surface that has been treated with a liquid hard-surface cleaning composition and hence to provide good shine to this surface. Furthermore, it is also desirable that said good shine persists after several rinsing cycles and hence long lasting shine is provide to the surface.

It has now been found that the above objects are met by formulating a liquid composition, having a neutral to alkaline pH, comprising a nonionic surfactant, a homo or copolymer of vinylpyrrolidone and a polysaccharide polymer, with the proviso that said composition does not comprise an amphoteric surfactant.

Advantageously, the liquid compositions of the present invention show an improved 'next-time' cleaning performance, compared to other hard-surface cleaners, on various types of stains/soils in particular greasy soils, e.g., greasy soap scum or greasy soils found in kitchens, and other tough stains found on hard-surfaces.

A further advantage of the liquid compositions of the present invention is that good first time cleaning in addition to improved 'next-time' cleaning performance is delivered.

Yet a further advantage of the compositions of the present invention is that faster drying is obtained on the surfaces that have been cleaned therewith. In other words, the consumer will notice the advantages reducing the total amount of time taken to clean hard-surfaces and reducing the inconvenience of having wet surfaces in the home.

Also it has surprisingly been found that the compositions according to the present invention deliver the benefits mentioned herein when used to treat a variety of surfaces including metal surfaces, such as aluminum, chromed steel, stainless steel, synthetic materials like vinyl, linoleum, glazed or non-glazed ceramic tiles, and/or enamel surfaces.

BACKGROUND ART

EP-A-0 017 149 discloses a liquid detergent composition comprising a nonionic surfactant and a water-soluble nonionic, weak anionic or cationic polymer. A composition comprising a homo or copolymer of vinylpyrrolidone in combination with a polysaccharide polymer is not exemplified. Furthermore, a 'next-time' cleaning benefit of the liquid detergent composition is not disclosed.

EP-A-0 511 091 discloses hard-surface cleaning compositions, having a pH of from 8.5 to 12.5, comprising a surfactant, an organic solvent, a sequestering agent and optionally polyvinyl pyrrolidone. A composition comprising a homo or copolymer of vinylpyrrolidone in combination with a polysaccharide polymer is not disclosed.

EP-A-0 635 567 discloses a method of facilitating the removal of soil from a solid surface using a liquid composition comprising a material which is deposited on the surface during washing and upon drying forms a layer adhered to said surface, whereby the removal of soil contaminants from said surface is facilitated. Such materials are film-forming polymeric materials preferred polyvinyl pyrrolidone. A composition comprising a homo or copolymer of vinylpyrrolidone in combination with a polysaccharide polymer is not disclosed.

EP-A-0 467 472 discloses a hard-surface modifying composition comprising an anti-soiling water-soluble anionic, cationic or nonionic polymer. Amongst the anti-soiling water-soluble anionic, cationic or nonionic polymer, polyvinyl pyrrolidone is disclosed. A composition comprising a homo or copolymer of vinylpyrrolidone in combination with a polysaccharide polymer is not disclosed.

SUMMARY OF THE INVENTION

The present invention relates to a liquid composition, having a pH of from 7 to 14, comprising a nonionic surfactant, a homo or copolymer of vinylpyrrolidone and a polysaccharide polymer, with the proviso that said composition does not comprise an amphoteric surfactant.

In a preferred embodiment, a solvent is added to said composition.

In other preferred embodiments the homo or copolymer of vinylpyrrolidone is vinylpyrrolidone homopolymer and the polysaccharide polymer is xanthan gum.

The present invention also encompasses a process of treating hard-surfaces, wherein a liquid composition according to the present invention is applied onto said surfaces.

DETAILED DESCRIPTION OF THE INVENTION

The Liquid Hard-surface Cleaning Composition

The compositions according to the present invention are designed as hard-surface cleaners.

The liquid compositions according to the present invention are preferably aqueous compositions. Therefore, they may comprise from 70% to 99%, preferably from 75% to 95% and more preferably from 85% to 95% by weight of the total composition of water.

The liquid compositions of the present invention have a neutral to alkaline pH, i.e., a pH of from 7 to 14, preferably from 7 to 12, more preferably from 7 to 10.

The compositions according to the present invention are advantageously chemically stable, i.e., there are virtually no chemical reactions between the different ingredients of the compositions, and physically stable, i.e., that no phase separation occurs when stored in rapid aging test (RAT), i.e., storage at 50° for 10 days.

Nonionic Surfactant

The first essential ingredient is a nonionic surfactant.

Typically, the compositions according to the present invention comprise from 0.1% to 20%, more preferably from 1% to 10%, even more preferably from 1% to 7%, and most preferably from 1% to 5% by weight of the total composition of a nonionic surfactant.

Suitable nonionic surfactants for use herein include a class of compounds, which may be broadly defined as compounds produced by the condensation of alkylene oxide groups (hydrophilic in nature) with an organic hydrophobic compound, which may be branched or linear aliphatic (e.g., Guerbet or secondary alcohol) or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Accordingly suitable nonionic synthetic detergents include:

(i) The polyethylene oxide condensates of alkyl phenols, e.g., the condensation products of alkyl phenols having an alkyl group containing from 6 to 20 carbon atoms in either a straight chain or branched chain configuration, preferably from 8 to 14, and more preferably from 8 to 12 carbon atoms, with ethylene oxide. Said ethylene oxide is typically present in amounts of from 3 to 25, preferably from 10 to 25 moles of ethylene oxide per mole of alkyl phenol. The alkyl substituent in such compounds may be derived from polymerized propylene, diisobutylene, octane, and nonane; Examples of this type of nonionic surfactants include TRITON N-57®, a nonyl phenol ethoxylate (5E0) from Rohm & Haas, and IMBENTIN 0200®, an octyl phenol ethoxylate (20E0) from KOLB.

(ii) Those derived from the condensation of ethylene oxide with the product resulting from the reaction of propylene oxide and ethylene diamine products which may be varied in composition depending upon the balance between the hydrophobic and hydrophilic elements which is desired. Examples are compounds containing from 40% to 80% polyoxyethylene by weight and having a molecular weight of from 5000 to 11000 resulting from the reaction of ethylene oxide groups with a hydrophobic base constituted of the reaction product of ethylene diamine and excess propylene oxide, said base having a molecular weight of the order of 2500 to 3000. Examples of this type of nonionic surfactants include certain of the commercially available TETRONIC™ compounds, marketed by BASF.

(iii) The condensation product of aliphatic alcohols having from 2 to 24 carbon atoms, in either straight chain or branched chain configuration, preferably from 6 to 22, more preferably from 6 to 28, and even more preferably 8 to 18 carbon atoms, with from 2 to 35, preferably from 4 to 25, more preferably from 5 to 18, and even more preferably 3 to 15 moles of ethylene oxide. Examples of this type of material are a coconut alcohol ethylene oxide condensate having from 5 to 18 moles of ethylene oxide per mole of coconut alcohol, the coconut alcohol fraction having from 9 to 14 carbon atoms. Other examples of this type of nonionic surfactants include certain of the commercially available DOBANOL®, NEODOL® marketed by Shell or LUTENSOL® from BASF. For example DOBANOL® 23.5 (C12–C13 E05), DOBANOL® 91.5 (C9–C11E05), DOBANOL® 91.8(C9–C11E08) and LUTENSOL® AO30(C12–C14EO30).

(iv) Trialkyl amine oxides and trialkyl phosphine oxides wherein one alkyl group ranges from 10 to 18 carbon atoms and two alkyl groups range from 1 to 3 carbon atoms; the alkyl groups can contain hydroxy substituents; specific examples are dodecyl di(2-hydroxyethyl) amine oxide and tetradecyl dimethyl phosphine oxide.

(v) The condensation products of ethylene oxide with a hydrophobic base formed by the condensation of propylene oxide with propylene glycol; the hydrophobic portion of these compounds will preferably have a molecular weight of from 1500 to 1800 and will exhibit water insolubility. The addition of polyoxyethylene moieties to this hydrophobic portion tends to increase the water solubility of the molecule as a whole, and the liquid character of the product is retained up to the point where the polyoxyethylene content is 50% of the total weight of the condensation product, which corresponds to condensation with up to 40 moles of ethylene oxide. Examples of compounds of this type include certain of the commercially available PLURONIC™ surfactants, marketed by BASF.

Also useful as a nonionic surfactant are the alkylpolysaccharides disclosed in U.S. Pat. No. 4,565,647, Llenado, issued Jan. 21, 1986, having a hydrophobic group containing from 6 to 30 carbon atoms, preferably from 10 to 16 carbon atoms and polysaccharide, e.g., a polyglycoside, hydrophilic group containing from 1.3 to 10, preferably from 1.3 to 3, most preferably from 1.3 to 2.7 saccharide units. Any reducing saccharide containing 5 or 6 carbon atoms can be used, e.g., glucose, galactose, and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions of the preceding saccharide units.

Optionally, and less desirable, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from 8 to 18, preferably from 10 to 16, carbon atoms. Preferably, the alkyl group can contain up to 3 hydroxy groups and/or the polyalkyleneoxide chain can contain up to 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula:

$$R^2O(C_nH_{2n}O)_t(\text{glucosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3, preferably 2; t is from 0 to 10, preferably 0; and x is from 1.3 to 10, preferably from 1.3 to 3, most preferably from 1.3 to 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantely the 2-position.

Other suitable nonionic surfactants for use herein include polyhydroxy fatty acid amides of the structural formula:

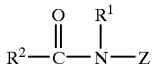

(I)

wherein: $R^1$ is H, $C_1$–$C_4$ hydrocarbyl, 2-hydroxy ethyl, 2-hydroxypropyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl. $R^2$—CO—N< can be, for example, cocamide, stearamide, oleamide, lauramide, myristamide, capricamide, palmitamide, tallowamide, etc. Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Other suitable nonionic surfactants for use herein include the amine oxides corresponding to the formula:

$$RR'R''NO\rightarrow O$$

wherein R is a primary alkyl group containing from 6 to 24 carbons, preferably from 10 to 18 carbons, and wherein R' and R" are, each, independently, an alkyl group containing 1 to 6 carbon atoms. The arrow in the formula is a conventional representation of a semi-polar bond. The preferred amine oxides are those in which the primary alkyl group has a straight chain in at least most of the molecules, generally at least 70%, preferably at least 90% of the molecules, and the amine oxides which are especially preferred are those in which R contains from 10 to 18 carbons and R' and R" are both methyl. Exemplary of the preferred amine oxides are the N-hexyldimethylamine oxide, N-octyidimethylamine oxide, N-decyldimethylamine oxide, N-dodecyl dimethylamine oxide, N-tetradecyldimethylamine oxide, N-hexadecyl dimethylamine oxide, N-octadecyldimethylamine oxide, N-eicosyldimethylamine oxide, N-docosyldimethylamine oxide, N-tetracosyl dimethylamine oxide, the corresponding amine oxides in which one or both of the methyl groups are replaced with ethyl or 2-hydroxyethyl groups and mixtures thereof. A most preferred amine oxide for use herein is N-decyldimethylamine oxide.

Other suitable nonionic surfactants for the purpose of the invention are the phosphine or sulfoxide surfactants of formula:

$$RR'R''A\rightarrow O$$

wherein A is phosphorus or sulfur atom, R is a primary alkyl group containing 6–24 carbons, preferably 10–18 carbons, and wherein R' and R" are, each, independently selected from methyl, ethyl and 2-hydroxyethyl. The arrow in the formula is a conventional representation of a semi-polar bond.

In a preferred embodiment herein suitable nonionic surfactants to be used are polyethylene oxide condensates of alkyl phenols, polyethylene oxide condensates of alkyl alcohols, alkylpolysaccharides, or mixtures thereof. Highly preferred are $C_6$–$C_{20}$, preferably $C_8$–$C_{12}$ alkyl phenol ethoxylates having from 3 to 25, preferably 10 to 25 ethoxy groups and $C_2$–$C_{24}$, preferably $C_8$–$C_{18}$ alcohol ethoxylates having from 2 to 35, preferably from 4 to 25, more preferably from 5 to 18 and most preferably from 3 to 15 ethylene oxide units, and mixtures thereof.

Vinylpyrrolidone Homopolymer or Copolymer

The liquid compositions of the present invention comprise as a second essential ingredient a vinylpyrrolidone homopolymer or copolymer. Typically, the compositions of the present invention comprise from 0.01% to 5%, more preferably from 0.05% to 3% and most preferably from 0.05% to 1% by weight of the total composition of a vinylpyrrolidone homopolymer or copolymer.

Suitable vinylpyrrolidone homopolymers for use herein are homopolymers of N-vinylpyrrolidone having the following repeating monomer:

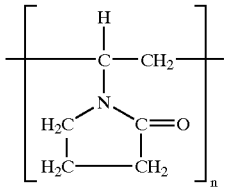

wherein n (degree of polymerisation) is an integer of from 10 to 1,000,000, preferably from 20 to 100,000, and more preferably from 20 to 10,000.

Accordingly, suitable vinylpyrrolidone homopolymers ("PVP") for use herein have an average molecular weight of from 1,000 to 100,000,000, preferably from 2,000 to 10,000,000, more preferably from 5,000 to 1,000,000, and most preferably from 50,000 to 500,000.

Suitable vinylpyrrolidone homopolymers are commercially available from ISP Corporation, New York, N.Y. and Montreal, Canada under the product names PVP K-15® (viscosity molecular weight of 10,000), PVP K-30® (average molecular weight of 40,000), PVP K-60® (average molecular weight of 160,000), and PVP K-90® (average molecular weight of 360,000). Other suitable vinylpyrrolidone homopolymers which are commercially available from BASE Cooperation include SOKALAN HP 165®, SOKALAN HP 12®, LUVISKOL K30®, LUVISKOL K60®, LUVISKOL K80®, LUVISKOL K90® and other vinylpyrrolidone homopolymers known to persons skilled in the detergent field (see for example EP-A-262,897 and EP-A-256,696).

Suitable copolymers of vinylpyrrolidone for use herein include copolymers of N-vinylpyrrolidone and alkylenically unsaturated monomers or mixtures thereof.

The alkylenically unsaturated monomers of the copolymers herein include unsaturated dicarboxylic acids such as maleic acid, chloromaleic acid, fumaric acid, itaconic acid, citraconic acid, phenylmaleic acid, aconitic acid, acrylic acid, N-vinylimidazole and vinyl acetate. Any of the anhydrides of the unsaturated acids may be employed, for example acrylate, methacrylate. Aromatic monomers like styrene, sulphonated styrene, alpha-methyl styrene, vinyl toluene, t-butyl styrene and similar well-known monomers may be used.

The molecular weight of the copolymer of vinylpyrrolidone is not especially critical so long as the copolymer is water-soluble, has some surface activity and is adsorbed to the hard-surface from the liquid composition comprising it in such a manner as to increase the hydrophilicity of the surface. However, the preferred copolymers of N-vinylpyrrolidone and alkylenically unsaturated monomers or mixtures thereof, have a molecular weight of between 1,000 and 1,000,000, preferably between 10,000 and 500,000 and more preferably between 10,000 and 200,000.

For example particularly suitable N-vinylimidazole N-vinylpyrrolidone polymers for use herein have an average molecular weight range from 5,000 to 1,000,000, preferably from 5,000 to 500,000, and more preferably from 10,000 to 200,000. The average molecular weight range was determined by light scattering as described in Barth H. G. and Mays J. W. Chemical Analysis Vol 113, "Modern Methods of Polymer Characterization".

Such copolymers of N-vinylpyrrolidone and alkylenically unsaturated monomers like PVP/vinyl acetate copolymers are commercially available under the trade name LUVISKOL® series from BASF.

The copolymers of vinylpyrrolidone for use in the compositions of the present invention also include quaternized or unquaternized vinylpyrrolidone/dialkylaminoalkyl acrylate or methacrylate copolymers.

Such vinylpyrrolidone/dialkylaminoalkyl acrylate or methacrylate copolymers (quaternised or unquaternised) suitable to be used in the compositions of the present invention are according to the following formula:

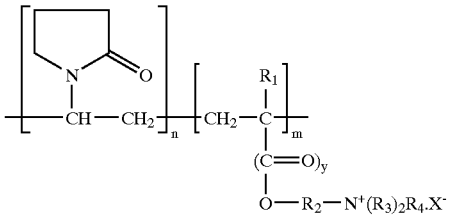

in which n is between 20 and 99 and preferably between 40 and 90 mol % and m is between 1 and 80 and preferably between 5 and 40 mol %; $R_1$ represents H or $CH_3$; y denotes 0 or 1; $R_2$ is —$CH_2$—CHOH—$CH_2$—or $C_xH_{2x}$, in which x=2 to 18; R3 represents a lower alkyl group of from 1 to 4 carbon atoms, preferably methyl or ethyl, or

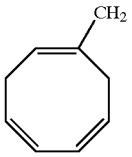

$R_4$ denotes a lower alkyl group of from 1 to 4 carbon atoms, preferably methyl or ethyl; X−is chosen from the group consisting of CI, Br, I, ½$SO_4$, $HSO_4$ and $CH_3SO_3$. The polymers can be prepared by the process described in French Pat. Nos. 2,077,143 and 2,393,573.

The preferred quaternized or unquaternized vinylpyrrolidone/dialkylaminoalkyl acrylate or methacrylate copolymers for use herein have a molecular weight of between 1,000 and 1,000,000, preferably between 10,000 and 500,000 and more preferably between 10,000 and 100,000.

Such vinylpyrrolidone/dialkylaminoalkyl acrylate or methacrylate copolymers are commercially available under the name COPOLYMER 845®, GAFQUAT 734®, or GAFQUAT 755® from ISP Corporation, New York, N.Y. and Montreal, Canada or from BASF under the tradename LUVIQUAT®.

Preferred second essential ingredient for use herein are the vinylpyrrolidone homopolymers.

Polysaccharide Polymer

The liquid compositions of the present invention comprise as a third essential ingredient a polysaccharide polymer. Typically, the compositions of the present invention comprise from 0.01% to 5%, more preferably from 0.05% to 3% and most preferably from 0.05 % to 1% by weight of the total composition of a polysaccharide polymer.

Suitable polysaccharide polymers for use herein include substituted cellulose materials like carboxymethylcellulose, ethyl cellulose, hydroxyethyl cellulose, hydroxypropyl cellulose, hydroxymethyl cellulose, succinoglycan and naturally occurring polysaccharide polymers like xanthan gum, guar gum, locust bean gum, tragacanth gum or derivatives thereof, or mixtures thereof.

Particularly suitable polysaccharide polymers for use herein are xanthan gum and derivatives thereof. Xanthan gum and derivatives thereof may be commercially available for instance from Kelco under the trade name KELTROL RD®, KELZAN S® or KELZAN T®. Other suitable Xanthan gum is commercially available by Rhone Poulenc under the trade name RHODOPOL T® and X747®. Succinoglycan gum for use herein is commercially available by Rhone Poulenc under the trade name RHEOZAN®.

The present invention is based on the finding that the vinylpyrrolidone homopolymers or copolymers and polysaccharide polymers present in the compositions of the present invention are able to modify the surface by depositing on the surface treated therewith. Although not wishing to be bound by theory, it has been observed that hard-surfaces typically found in a household are neither highly hydrophobic nor highly hydrophilic. This means that, when water comes into contact with hard-surfaces, its dispersion, which is controlled by interfacial energy (i.e., solid/liquid surface tension), is very limited. Indeed, it has been observed that the most stable configuration for the water is grouping into spherical droplets rather than forming a thin film uniformly spread over the surface. Then, as water droplets evaporate, their content of salt progressively becomes higher and higher so that carbonate salts eventually precipitate resulting in watermarks or even limescale deposits. The end result is a reduction of surface shine.

It has now been found that when the vinylpyrrolidone homopolymers or copolymers as described herein are added into liquid compositions, having a neutral to alkaline pH, a hydrophilic layer is left on the hard-surface treated with said composition. The hydrophilic layer facilitates the formation of a uniform film of water spread over the surface ("sheeting effect") instead of forming droplets. It has further been found that when the polysaccharide polymers as described herein are added into liquid compositions, having a neutral to alkaline pH, comprising the vinylpyrrolidone homopolymers or copolymers, the hydrophilic modification of the surface treated therewith is enhanced and the quality of said sheeting effect is magnified resulting in a further improved shine benefit delivered to the treated surface. Furthermore, it has surprisingly been found that the presence of a nonionic surfactant in addition to these two polymers in a composition, having a neutral to alkaline pH, results in an improved adsorption of the vinylpyrrolidone homopolymers or copolymers onto the treated hard-surfaces and therefore further magnifies the sheeting effect, resulting in an even further improved shine benefit delivered to the treated surface ("shine benefit"). Thus, by modifying the surface features as indicated, the formation of watermarks and/or limescale deposits upon drying is reduced or even eliminated.

Furthermore, it has surprisingly been found that the vinylpyrrolidone homopolymers or copolymers and polysaccharide polymers have not only the ability to adhere to a surface treated with the liquid compositions of the present invention comprising the same, but still remain adhered on the surface even after several cycles of rinsing (e.g., when water comes onto this surface later on for example in a sink during daily household operation), thus providing long lasting protection against formation of watermarks and/or deposition of limescale deposits, hence, long lasting shiny surfaces ("long lasting shine benefit").

Additionally, the hydrophilic layer reduces adhesion of soils onto said hard-surface treated with the composition according to the present invention and/or facilitate removal of soils subsequently deposited thereon. Thus, less effort (e.g., less scrubbing and/or less wiping and/or less chemical action) is required to remove the soils in the next cleaning operation ("'next-time' cleaning benefit"), as compared to the cleaning of a similarly soiled hard-surface which has been first treated with the same composition but wherein one of the essential ingredients is absent.

More particularly, it has surprisingly been found that there is a synergistic effect on 'next-time' cleaning performance associated with the use of a vinylpyrrolidone homopolymer or copolymer and a polysaccharide polymer, as defined herein. Indeed, the 'next-time' cleaning performance delivered by the use of a vinylpyrrolidone homopolymer or copolymer and a polysaccharide polymer, as defined herein, in a liquid composition, is superior to the 'next-time' cleaning performance delivered by, e.g., the same composition comprising only one of those ingredients at the same total level of anti-resoiling ingredients. Furthermore, it has surprisingly been found that the addition of a nonionic surfactant in addition to the combination of said two polymers in a liquid composition, having a neutral to alkaline pH, further enhances the improved 'next-time' cleaning benefit delivered by a composition, having a neutral to alkaline pH, comprising said two polymers, as described herein, in absence of the nonionic surfactant.

An additional advantage related to the use of the vinylpyrrolidone homopolymers or copolymers and polysaccharide polymers, in the compositions herein, is that as they adhere on the hard-surfaces making them more hydrophilic, the surfaces themselves become smoother (this can be perceived by touching said surfaces) and this contributes to convey perception of the surfaces as being perfectly descaled.

Advantageously, these benefits are obtained at low levels of vinylpyrrolidone homopolymers or copolymers and polysaccharide polymers, preferably xanthan gum or derivatives thereof, described herein, thus, it is yet another advantage of the present invention to provide the desired benefits at low cost.

Optional Ingredients

The liquid compositions according to the present invention may comprise a variety of optional ingredients depending on the technical benefit aimed for and the surface treated.

Suitable optional ingredients for use herein include a source of alkalinity, a solvent, other surfactants than nonionic or amphoteric surfactants, a builder, a chelant, a buffer, a bactericide, a hydrotrope, a colorant, a stabilizer, a radical scavenger, a bleach, a bleach activator, a preservative, a suds controlling agent like a fatty acid, an enzyme, a soil suspender, a dye transfer agent, a brightener, an anti dusting agent, a dispersant, a dye transfer inhibitor, a pigment, an acid, a dye and/or a perfume.

Source of Alkalinity

The liquid compositions of the present invention have a neutral to alkaline pH. Thus, they may comprise as a highly preferred optional ingredient a source of alkalinity.

The amount of said source of alkalinity herein may vary depending on the amount of other ingredients. Preferred liquid compositions herein may comprise up to 10%, preferably of from 0.1% to 10%, more preferably of from 0.2% to 8% and even more preferably from 0.2% to 6% by weight of the total composition of a source of alkalinity.

Suitable sources of alkalinity for use herein are the caustic alkalis such as sodium hydroxide, potassium hydroxide and/or lithium hydroxide, and/or the alkali metal oxides such as sodium and/or potassium oxide. A preferred strong source of alkalinity is a caustic alkali, more preferably sodium hydroxide and/or potassium hydroxide.

Other suitable sources of alkalinity include ammonia, ammonium carbonate and hydrogen carbonate.

Solvent

The compositions of the present invention may further comprise a solvent, as a highly preferred optional ingredient. Solvents to be used herein include all those known to the those skilled in the art of hard-surfaces cleaner compositions.

Solvents are desired herein because they contribute to the greasy soils cleaning performance of the composition herein, they also improve the wettability of the surfaces being treated with said composition to maximize the polymers adsorption on the treated surface, with consequent improved sheeting effect and therefore even enhances the advantages of the present invention, described herein.

Suitable solvents for use herein include ethers and diethers having from 4 to 14 carbon atoms, preferably from 6 to 12 carbon atoms, and more preferably from 8 to 10 carbon atoms, glycols or alkoxylated glycols, alkoxylated aromatic alcohols, aromatic alcohols, aliphatic branched alcohols, alkoxylated aliphatic branched alcohols, alkoxylated linear $C_1$–$C_5$ alcohols, linear $C_1$–$C_5$ alcohols, $C_8$–$C_{14}$ alkyl and cycloalkyl hydrocarbons and halohydrocarbons, $C_6$–$C_{16}$ glycol ethers and mixtures thereof.

Suitable glycols to be used herein are according to the formula HO—CR1R2-OH wherein $R_1$ and R2 are independently H or a $C_2$–$C_{10}$ saturated or unsaturated aliphatic hydrocarbon chain and/or cyclic. Suitable glycols to be used herein are dodecaneglycol and/or propanediol.

Suitable alkoxylated glycols to be used herein are according to the formula R—(A)n-R1-OH wherein R is H, OH, a linear saturated or unsaturated alkyl of from 1 to 20 carbon atoms, preferably from 2 to 15 and more preferably from 2 to 10, wherein R1 is a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable alkoxylated aromatic alcohols to be used herein are according to the formula R—$(A)_n$—OH wherein R is an alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable alkoxylated aromatic alcohols are benzoxyethanol and/or benzoxypropanol.

Suitable aromatic alcohols to be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable aliphatic branched alcohols to be used herein are according to the formula R—OH wherein R is a branched saturated or unsaturated alkyl group of from 1 to 20 carbon atoms, preferably from 2 to 15 and more preferably from 5 to 12. Particularly suitable aliphatic branched alcohols to be used herein include 2-ethylbutanol and/or 2-methylbutanol.

Suitable alkoxylated aliphatic branched alcohols to be used herein are according to the formula R—$(A)_n$—OH wherein R is a branched saturated or unsaturated alkyl group of from 1 to 20 carbon atoms, preferably from 2 to 15 and more preferably from 5 to 12, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol.

Suitable alkoxylated linear $C_1$—$C_5$ alcohols to be used herein are according to the formula R—$(A)_n$—OH wherein R is a linear saturated or unsaturated alkyl group of from 1 to 5 carbon atoms, preferably from 2 to 4, wherein A is an alkoxy group preferably butoxy, propoxy and/or ethoxy, and n is an integer of from 1 to 5, preferably 1 to 2. Suitable alkoxylated aliphatic linear $C_1$ –$C_5$ alcohols are butoxy propoxy propanol (n-BPP), butoxyethanol, butoxypropanol, ethoxyethanol or mixtures thereof. Butoxy propoxy propanol is commercially available under the trade name n-BPP® from Dow chemical.

Suitable linear $C_1$–$C_5$ alcohols to be used herein are according to the formula R—OH wherein R is a linear saturated or unsaturated alkyl group of from 1 to 5 carbon atoms, preferably from 2 to 4. Suitable linear $C_1$–$C_5$ alcohols are methanol, ethanol, propanol or mixtures thereof.

Other suitable solvents include butyl diglycol ether (BDGE), butyltriglycol ether, ter amilic alcohol and the like. Particularly preferred solvents to be used herein are butoxy propoxy propanol, butyl diglycol ether, benzyl alcohol, butoxypropanol, ethanol, methanol, isopropanol and mixtures thereof.

The preferred solvent for use herein is butoxy propoxy propanol (n-BPP).

Typically, the compositions of the present invention comprise from 0.1% to 8%, preferably from 0.5% to 5% and more preferably from 1 % to 3% by weight of the total composition of a solvent.

Additional Surfactant

The liquid compositions of the present invention may preferably comprise an additional surfactant, in addition to the nonionic surfactant already described herein. Additional surfactants may be desired herein as they further contribute to the cleaning performance and/or shine benefit of the compositions of the present invention. Surfactants to be used herein include cationic surfactants, anionic surfactants, zwitterionic surfactants, and mixtures thereof. The compositions according to the present invention do not comprise an amphoteric surfactant.

Accordingly, the compositions according to the present invention may comprise up to 15%, more preferably from 0.5% to 8%, even more preferably from 0.5% to 8%, and most preferably 0.5% to 8% by weight of the total composition of another surfactant in addition to the nonionic surfactant already described herein.

Preferred surfactants for use herein are zwitterionic surfactants. Indeed, they provide excellent grease cleaning ability to the compositions of the present invention.

Suitable zwitterionic surfactants for use herein contain both basic and acidic groups which form an inner salt giving both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylates and sulfonates, although other groups like sulfates, phosphonates, and the like can be used.

A generic formula for preferred zwitterionic surfactants for use herein (i.e., betaine and/or sulfobetaine) is:

$$R_1—N^+(R_2)(R_3)R_4X^-$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ carboxylic acid group or a $C_1$–$C_6$ sulfonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group which is a carboxylate or sulfonate group, preferably sulfonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula $R_a$—C(O)—$NR_b$—$(C(R_c)_2)_m$, wherein $R_a$ is an aliphatic or aromatic, saturated or unsaturated, substituted or unsubstituted hydrocarbon chain containing from 8 up to 20 carbon atoms, preferably an alkyl group containing from 8 up to 20 carbon atoms, preferably up to 18, more preferably up to 16, $R_b$ is either a hydrogen a short chain alkyl or substituted alkyl containing from 1 to 4 carbon atoms, preferably a group selected from the group consisting of methyl, ethyl, propyl, hydroxy substituted ethyl or propyl and mixtures thereof, more preferably methyl or hydrogen, $R_c$ is selected from the group consisting of hydrogen and hydroxy groups, and m is from 1 to 4, preferably from 2 to 3, more preferably 3, with no more than one hydroxy group in any $(C(R_C)_2)$ moiety.

Preferred $R_2$ is hydrogen, or an alkyl or substituted alkyl containing from 1 to 4 carbon atoms, preferably a group selected from the group consisting of methyl, ethyl, propyl, hydroxy substituted ethyl or propyl and mixtures thereof, more preferably methyl. Preferred $R_3$ is a $C_1$–$C_4$ carboxylic acid group, a $C_1$–$C_4$ sulfonate group, or an alkyl or substituted alkyl containing from 1 to 4 carbon atoms, preferably a group selected from the group consisting of methyl, ethyl, propyl, hydroxy substituted ethyl or propyl and mixtures thereof, more preferably methyl. Preferred $R_4$ is $(CH_2)_n$ wherein n is an integer from 1 to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N-decyl-N, Ndimethylammonia)acetate, 2-(N-coco N, N-dimethylammonio) acetate, myristyl dimethyl betaine, palmityl dimethyl betaine, cetyl dimethyl betaine, stearyl dimethyl betaine. For example, Coconut dimethyl betaine is commercially available from Seppic under the trade name of AMONYL 265®. Lauryl betaine is commercially available from Albright & Wilson under the trade name EMPIGEN BB/L®.

A further example of betaine is Lauryl-iminodipropionate commercially available from Rhone-Poulenc under the trade name MIRATAINE H2C-HA®.

Particularly preferred zwitterionic surfactants for use in the compositions of the present invention are the sulfobetaine surfactants as they deliver optimum grease cleaning benefits.

Examples of particularly suitable sulfobetaine surfactants include tallow bis(hydroxyethyl) sulphobetaine, cocoamido propyl hydroxy sulfobetaines which are commercially available from Rhone Poulenc and Witco, under the trade name of MIRATAINE CBS® and REWOTERIC AM CAS 15® respectively.

Further examples of amidobetaines/amidosulfobetaine include cocoamidoethylbetaine, cocoamidopropyl betaine or $C_{10}$–$C_{14}$ fatty acylamidopropylene(hydropropylene) sulfobetaine. For example $C_{10}$–$C_{14}$ fatty acylamidopropylene(hydropropylene)sulfobetaine is commercially available from Sherex Company under the trade name "VARION CAS® sulfobetaine".

Suitable amines for use herein are for instance $C_{12}$ dimethyl amine, coconut dimethyl amine, $C_{12}$–$C_6$ dimethyl amine. Said amines may be commercially available from Hoechst under the trade name GENAMIN®, AKZO under the trade name AROMOX® or Fina under the trade name RADIAMINE®.

Suitable quaternary ammonium surfactants for use herein are according to the formula $R_1R_2R_3R_4N^+X^-$, wherein X is a counteranion such as halogen, methyl sulphate, methyl sulphonate, or hydroxide, $R_1$ is a saturated or unsaturated, substituted or unsubstituted, linear or branched alkyl group containing from 1 to 30 carbon atoms, preferably from 12 to 20, more preferably from 8 to 20 and $R_2$, $R_3$ and $R_4$ are independently hydrogen, or saturated or unsaturated, substituted or unsubstituted, linear or branched alkyl groups containing from 1 to 4 carbon atoms, preferably from 1 to 3 and more preferably methyl. In highly preferred quaternary ammonium surfactants herein $R_1$ is a $C_{10}$–$C_{18}$ hydrocarbon chain, most preferably $C_{12}$, $C_{14}$, or $C_{16}$, and $R_2$, $R_3$ and $R_4$ are all three methyl, and X is halogen, preferably bromide or chloride, most preferably bromide.

Examples of quaternary ammonium surfactants are myristyl trimethylammonium methyl sulphate, cetyl trimethylammonium methyl sulphate, lauryl trimethyl ammonium bromide, stearyl trimethyl ammonium bromide (STAB), cetyl trimethyl ammonium bromide (CTAB)and myristyl trimethyl ammonium bromide (MTAB). Highly preferred herein are lauryl trimethyl ammonium salts. Such trimethyl quaternary ammonium surfactants may be commercially available from Hoechst, or from Albright & Wilson under the trade name EMPIGEN CM®.

Cationic surfactants suitable for use in compositions of the present invention are those having a long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from 8 to 18 carbon atoms in the alkyl chain, each $R^3$ is selected from the group consisting of —$CH_2CH_2$—, —$CH_2CH(CH_3)$—, —$CH_2CH(CH_2CH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than 1000, and hydrogen when y is not 0; $R^5$ is the same as $R^4$ or is an alkyl chain wherein the total number of carbon atoms of $R^2$ plus $R^5$ is not more than 18; each y is from 0 to 10 and the sum of the y values is from 0 to 15; and X is any compatible anion.

Other cationic surfactants useful herein are also described in U.S. Pat. No. 4,228,044, Cambre, issued Oct. 14, 1980, incorporated herein by reference.

Suitable anionic surfactants for use herein are all those commonly known by those skilled in the art. Preferably, the anionic surfactants for use herein include alkyl sulphonates, alkyl aryl sulphonates, alkyl sulphates, alkyl alkoxylated sulphates, $C_6$–$C_{20}$ alkyl alkoxylated linear or branched diphenyl oxide disulphonates, or mixtures thereof.

Suitable alkyl sulphonates for use herein include water-soluble salts or acids of the formula $RSO_3M$ wherein R is a $C_6$–$C_{20}$ linear or branched, saturated or unsaturated alkyl group, preferably a $C_8$–$C_{18}$ alkyl group and more preferably a $C_{10}$–$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$–$C_{20}$ linear or branched saturated or unsaturated alkyl group, preferably a $C_8$–$C_{18}$ alkyl group and more preferably a $C_{10}$–$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

By "secondary $C_6$–$C_{20}$ alkyl or $C_6$–$C_{20}$ alkyl aryl sulphonates", it is meant herein that in the formula as defined above, the $SO_3M$ or aryl-$SO_3M$ group is linked to a carbon atom of the alkyl chain being placed between two other carbons of the said alkyl chain (secondary carbon atom).

An example of a $C_{14}$–$C_{16}$ alkyl sulphonate is HOSTAPUR® SAS available from Hoechst. An example of commercially available alkyl aryl sulphonate is Lauryl aryl sulphonate from Su.Ma. Particularly preferred alkyl aryl sulphonates are alkyl benzene sulphonates commercially available under trade name NANSA® available from Albright&Wilson.

Suitable alkyl sulphate surfactants for use herein are according to the formula $R_1SO_4M$ wherein $R_1$ represents a hydrocarbon group selected from the group consisting of straight or branched alkyl radicals containing from 6 to 20 carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

By "linear alkyl sulphate or sulphonate" it is meant herein a non-substituted alkyl sulphate or sulphonate wherein the alkyl chain comprises from 6 to 20 carbon atoms, preferably from 8 to 18 carbon atoms, and more preferably from 10 to 16 carbon atoms, and wherein this alkyl chain is sulphated or sulphonated at one terminus.

By "branched sulphonate or sulphate", it is meant herein an alkyl chain having from 6 to 20 total carbon atoms, preferably from 8 to 18 total carbon atoms, and more preferably from 10 to 16 total carbon atoms, wherein the main alkyl chain is substituted by at least another alkyl chain, and wherein the alkyl chain is sulphated or sulphonated at one terminus.

Particularly preferred branched alkyl sulphates to be used herein are those containing from 10 to 14 total carbon atoms like ISALCHEM 123 AS®. ISALCHEM 123 AS® commercially available from Enichem is a $C_{12-13}$ surfactant which is 94% branched. This material can be described as $CH_3(CH_2)_mCH(CH_2OSO_3Na)$—$(CH_2)_n$—$CH_3$ where n+m=8–9. Also preferred alkyl sulphates are the alkyl sulphates where the alkyl chain comprises a total of 12 carbon atoms, i.e., sodium 2-butyl octyl sulphate. Such alkyl sulphate is commercially available from Condea under the trade name ISOFOL® 12S. Particularly suitable liner alkyl sulphonates include $C_{12}$–$C_{16}$ paraffin sulphonate like HOSTAPUR® SAS commercially available from Hoechst.

Suitable alkyl alkoxylated sulphate surfactants for use herein are according to the formula $RO(A)_mSO_3M$ wherein R is an unsubstituted $C_6$–$C_{20}$ alkyl or hydroxyalkyl group having a $C_6$–$C_{20}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}$E(1.0)M), $C_{12}$–$C_{18}$ alkyl polyethoxylate (2.25) sulfate, $C_{12}$–$C_{18}$E(2.25)M), $C_{12}$–$C_{18}$ alkyl polyethoxylate (3.0) sulfate $C_{12}$–$C_{18}$E(3.0), and $C_{12}$–$C_{18}$ alkyl polyethoxylate (4.0) sulfate $C_{12}$–$C_{18}$E(4.0)M), wherein M is conveniently selected from sodium and potassium.

Suitable $C_6$–$C_{20}$ alkyl alkoxylated linear or branched diphenyl oxide disulphonate surfactants for use herein are according to the following formula:

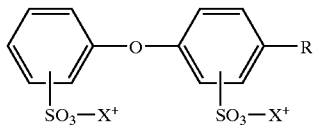

wherein R is a $C_6$–$C_{20}$ linear or branched, saturated or unsaturated alkyl group, preferably a $C_{12}$–$C_{18}$ alkyl group and more preferably a $C_{14}$–$C_{16}$ alkyl group, and X+ is H or a cation, e.g., an alkali metal cation (e.g., sodium, potassium, lithium, calcium, magnesium and the like). Particularly suitable $C_6$–$C_{20}$ alkyl alkoxylated linear or branched diphenyl oxide disuiphonate surfactants to be used herein are the C12 branched diphenyl oxide disulphonic acid and C16 linear diphenyl oxide disulphonate sodium salt respectively commercially available by DOW under the trade name DOWFAX 2A1® and DOWFAX 83908®.

Other anionic surfactants useful herein include salts (including, for example, sodium, potassium, ammonium, and substituted ammonium salts such as mono-, di- and triethanolamine salts) of soap, $C_8$–$C_{24}$ olefinsulfonates, sulphonated polycarboxylic acids prepared by sulphonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Dye

The liquid compositions according to the present invention may be coloured. Accordingly, they may comprise a dye. Suitable dyes for use herein are stable dyes. By "stable", it is meant herein a compound which is chemically and physically stable in the neutral to alkaline environment of the compositions herein.

Preservative

The compositions according to the present invention may further comprise a preservative as an optional ingredient. Preservatives to be used herein include all those known to those skilled in the art ho hard-surface cleaner compositions.

Preservatives are desired herein because they contribute to the stability of the compositions herein.

Suitable preservatives for use herein are diazolidinyl urea, triethyl citrate, propyl 4-hydroxybenzoate, sorbic acid, Na salt of p-hydroxybenzoate or gluteraldehyde or a mixture thereof.

Acid

In order to maintain the pH of the composition herein disclosed, the composition may further comprise an acid, as an optional ingredient. Typically, the acids to be used herein may be any organic or inorganic acid well-known to those skilled in the art of hard-surfaces cleaner compositions.

Preferably, the organic acids for use herein have a pK of less than 7. Suitable organic acids for use herein, are those selected from the group consisting of citric acid, maleic acid, lactic acid, glycolic acid, succinic acid, glutaric acid and adipic acid, and mixtures thereof. A mixture of said acids suitable for use herein is commercially available from BASF under the trade name SOKALAN® DCS. A preferred acid for use herein is citric acid.

Preferably, the inorganic acids for use herein have a pK of less than 3. Suitable inorganic acids for use herein, are those selected from the group consisting of sulphuric acid, chloridric acid, phosphoric acid, nitric acid, and mixtures thereof.

Acids when used, are typically present herein in amounts between 0.5% and 10%, preferably between 1% and 8%, and most preferably between 2% and 6% by weight of the total composition particularly when citric acid is used.

Radical Scavenger

The compositions of the present invention may comprise a radical scavenger.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris (2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name NIPANOX S1®.

Radical scavengers when used, are typically present herein in amounts up to 10% and preferably from 0.001% to 0.5% by weight of the total composition.

The presence of radical scavengers may contribute to the chemical stability of the compositions of the present invention.

Perfume

The compositions according to the present invention may further comprise a perfume.

Suitable perfumes for use herein include materials which provide an olfactory aesthetic benefit and/or cover any "chemical" odour that the product may have.

The main function of a small fraction of the highly volatile, low boiling (having low boiling points), perfume components in these perfumes is to improve the fragrance odour of the product itself, rather than impacting on the subsequent odour of the surface being cleaned. However, some of the less volatile, high boiling perfume ingredients provide a fresh and clean impression to the surfaces, and it is desirable that these ingredients be deposited and present on the dry surface. Perfume ingredients can be readily solubilized in the compositions, for instance by the anionic detergent surfactants. The perfume ingredients and compositions suitable to be used herein are the conventional ones known in the art. Selection of any perfume component, or amount of perfume, is based solely on aesthetic considerations.

Suitable perfume compounds and compositions can be found in the art including U.S. Pat. No. 4,145,184, Brain and Cummins, issued Mar. 20, 1979; U.S. Pat. No. 4,209,417, Whyte, issued Jun. 24, 1980; U.S. Pat. No. 4,515,705, Moeddel, issued May 7, 1985; and U.S. Pat. No. 4,152,272, Young, issued May 1, 1979, all of said patents being incorporated herein by reference. In general, the degree of substantivity of a perfume is roughly proportional to the percentages of substantive perfume material used. Relatively substantive perfumes contain at least 1%, preferably at least 10%, substantive perfume materials. Substantive perfume materials are those odorous compounds that deposit on surfaces via the cleaning process and are detectable by people with normal olfactory acuity. Such materials typically have vapour pressures lower than that of the average perfume material. Also, they typically have molecular weights of 200 and above, and are detectable at levels below those of the average perfume material. Perfume ingredients useful herein, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, ciscitral (neral), citronellal, citronellol, citronellyl acetate, para-cymene, decanal, dihydrolinalool, dihydromyrcenol, dimethyl phenyl carbinol, eucaliptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, mycrene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain 95% of d-limonene.

Examples of moderately volatile perfume ingredients are amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3-cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, trichioromethyl phenyl carbinyl acetate, triethyl citrate, vanillin, and veratraldehyde. Cedarwood terpenes are composed mainly of alpha-cedrene, beta-cedrene, and other $C_{15}H_{24}$ sesquiterpenes.

Examples of the less volatile, high boiling, perfume ingredients are benzophenone, benzyl salicylate, ethylene brassylate, galaxolide (1,3,4,6,7, 8-hexahydro-4,6,6,7,8,8-hexamethyl-cyclopenta-gama-2-benzopyran), hexyl cinnamic aldehyde, lyral (4-(4-hydroxy-4-methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate.

Selection of any particular perfume ingredient is primarily dictated by aesthetic considerations.

The compositions herein may comprise a perfume ingredient, in amounts up to 5.0%, preferably in amounts of 0.1% to 1.5% by weight of the total composition.

Chelating Agent

Another class of optional compounds for use herein includes chelating agents. Chelating agents may be incorporated in the compositions herein in amounts ranging up to 10.0%, preferably 0.01% to 5.0% by weight of the total composition.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilotrimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy -3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer, have been extensively described in U.S. Pat. No. 4,704,233, Nov. 3, 1987, to Hartman and Perkins. Ethylenediamine N,N' disuccinic acid is, for instance, commercially available under the tradename SSEDDS® from Palmer Research Laboratories.

Suitable amino carboxylates to be used herein include ethylene diamine tetra acetates, diethylene triamine pentaacetates, diethylene triamine pentaacetate (DTPA), N-hydroxyethylethylened iamine triacetates, nitrilotriacetates, ethylenediamine tetrapropionates, triethylenetetraaminehexa-acetates, ethanoldiglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name TRILON FS® and methyl glycine di-acetic acid (MGDA).

Further carboxylate chelating agents to be used herein include salicylic acid, aspartic acid, glutamic acid, glycine, malonic acid or mixtures thereof.

Bleaches

The liquid compositions herein may also comprise a bleaching component. Any bleach known to those skilled in the art may be suitable to be used herein including any peroxygen bleach as well as any hypohalite bleach.

Suitable peroxygen bleaches for use herein include hydrogen peroxide or sources thereof. As used herein a source of hydrogen peroxide refers to any compound which produces active oxygen when said compound is in contact with water. Suitable water-soluble sources of hydrogen peroxide for use herein include percarbonates, preformed percarboxylic acids, persilicates, persulphates, perborates, organic and inorganic peroxides and/or hydroperoxides.

Suitable hypohalite bleaches for use herein include chlorine releasing components as, e.g., alkali metal hypochlorites. Advantageously, the compositions according to the present invention are stable in presence of this bleaching component. Although alkali metal hypochlorites are preferred, other hypochlorite compounds may also be used herein and, e.g., can be selected from calcium and magnesium hypochlorite. A preferred alkali metal hypochlorite for use herein is sodium hypochlorite.

Bleach Activators

The compositions of the present invention that comprise a peroxygen bleach may further comprise a bleach activator. By "bleach activator", it is meant herein a compound which reacts with peroxygen bleach like hydrogen peroxide to form a peracid. The peracid thus formed constitutes the activated bleach. Suitable bleach activators to be used herein include those belonging to the class of esters, amides, imides, or anhydrides. Examples of suitable compounds of this type are disclosed in British Pat. No. GB 1 586 769 and GB 2 143 231 and a method for their formation into a prilled form is described in European Published Pat. No. Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition.

Packaging Form of the Compositions

The compositions herein may be packaged in a variety of suitable detergent packaging known to those skilled in the art. The liquid compositions are preferably packaged in conventional detergent plastic bottles.

In one embodiment the compositions herein may be packaged in manually or electrically operated spray dispensing containers, which are usually made of synthetic organic polymeric plastic materials. Accordingly, the present invention also encompasses liquid cleaning compositions of the invention packaged in a spray dispenser, preferably in a trigger spray dispenser or pump spray dispenser.

Indeed, said spray-type dispensers allow to uniformly apply to a relatively large area of a surface to be cleaned the liquid cleaning compositions suitable for use according to the present invention. Such spray-type dispensers are particularly suitable to clean vertical surfaces.

Suitable spray-type dispensers to be used according to the present invention include manually operated foam trigger-type dispensers sold for example by Specialty Packaging Products, Inc. or Continental Sprayers, Inc. These types of dispensers are disclosed, for instance, in U.S. Pat. No. 4,701,311 to Dunnining et al. and U.S. Pat. No. 4,646,973 and U.S. Pat. No. 4,538,745 both to Focarracci. Particularly preferred to be used herein are spray-type dispensers such as T 8500® commercially available from Continental Spray International or T 8100® commercially available from Canyon, Northern Ireland. In such a dispenser the liquid composition is divided in fine liquid droplets resulting in a spray that is directed onto the surface to be treated. Indeed, in such a spray-type dispenser the composition contained in the body of said dispenser is directed through the spray-type dispenser head via energy communicated to a pumping mechanism by the user as said user activates said pumping mechanism. More particularly, in said spray-type dispenser head the composition is forced against an obstacle, e.g., a grid or a cone or the like, thereby providing shocks to help atomise the liquid composition, i.e., to help the formation of liquid droplets.

The Process of Treating a Hard-surface

The present invention also encompasses a process of treating a hard-surface wherein a liquid composition as described herein is contacted with a hard-surface.

By "hard-surfaces" it is meant herein any kind of surfaces typically found in houses like bathrooms, kitchens, or in car interiors or exteriors, e.g., floors, walls, tiles, windows, sinks, showers, shower plastified curtains, wash basins, WCs, dishes, fixtures and fittings and the like made of different materials like ceramic, vinyl, no-wax vinyl, linoleum, melamine, glass, any plastics, plastified wood, metal or any painted or varnished or sealed surface and the like. Hard-surfaces also include household appliances including, but not limited to, washing machines, automatic dryers, refrigerators, freezers, ovens, microwave ovens, dishwashers and so on.

The liquid composition of the present invention may be contacted to the surface to be treated in its neat form or in its diluted form.

By "diluted form", it is meant herein that said liquid composition is diluted by the user typically with water. The composition is diluted prior to use to a typical dilution level of 10 to 400 times its weight of water, preferably from 10 to 200 and more preferably from 10 to 100. A usually recommended dilution level is a 1.2% dilution of the composition in water.

By "in its neat form", it is to be understood that the liquid compositions are applied directly onto the hard-surface to be treated without undergoing any dilution, i.e., the liquid compositions herein are applied onto the hard-surface as described herein.

A preferred process of treating a hard-surface according to the present invention, is to apply the composition in diluted form without rinsing the hard-surface after application in order to obtain excellent 'first-time' and 'next-time' cleaning performance as well as delivering good shine to said hard-surface.

Another preferred process of treating a hard-surface, is to apply the composition, described by the present invention, either in neat or diluted form, leave it on said surface to act, optionally wipe said surface with an appropriate instrument, e.g., a sponge, and then preferably rinse said surface with water.

The hard-surfaces to be treated may be soiled with a variety of soils, e.g., greasy soils (e.g., greasy soap scum, body grease, kitchen grease or burnt/sticky food residues typically found in a kitchen and the like).

By "treating" it is meant herein, cleaning, as the composition according to the present invention provides excellent 'first-time' and 'next-time' cleaning performance on various stains, especially greasy soils.

Cleaning Performance Test Method

The dilute cleaning performance may be evaluated by the following test method: tiles of enamel, vinyl or ceramic are prepared by applying to them a representative grease/particulate artificial soil followed by ageing. The test compositions and the reference composition are diluted (e.g., composition:water 1:50 or 1:100), applied to a sponge, and used to clean the tiles with a Sheen scrub tester. The number of strokes required to clean to 100% clean is recorded. A minimum of 6 replicates can be taken with each result being generated in duplicate against the reference on each soiled tile.

The test method for evaluating neat cleaning performance is identical to above except that the test compositions and reference are used undiluted and that after cleaning a rinsing cycle is performed with clean water.

Greasy Soap Scum Cleaning Performance Test Method

In this test method enamel white tiles (typically 24 cm*4 cm) are covered with typical greasy soap scum soils mainly based on calcium stearate and artificial body soils commercially available (e.g., 0.3 grams with a sprayer). The soiled tiles are then dried in an oven at a temperature of 140° C. for 20 minutes and then aged overnight at room temperature (around 20° C.–25° C.). Then the soiled tiles are cleaned using 3 ml of the liquid composition of the present invention poured directly on a SPONTEX® sponge. The ability of the composition to remove greasy soap scum is measured through the number of strokes needed to perfectly clean the surface. The lower the number of strokes, the higher the greasy soap scums cleaning ability of the composition.

Next Time-cleaning Benefit Test Method

In this test method stainless steel tap or black ceramic is treated with the liquid composition of the present invention by directly pouring said composition on a SPONTEX® sponge and rubbing said tiles with said sponge. Then the tiles are thoroughly rinsed with tap water and let to dry. Soapy water (about 100 ml) is splashed on the dry surface and rinsed with running tap water (about 100 ml). The surface of the tiles is again left to dry and the procedure of splashing soapy water on said tiles is repeated for 4–6 times.

The ability of a composition to provide next time-cleaning benefit on the surface refers to the composition's ability to modify the surface in such a way, that the soapy water is rinsed away more easily on surfaces treated with the liquid composition of the present invention compared to surfaces not treated with said composition. This can be evaluated by human visual grading.

Shine Test Method

Obtaining a good shine end result results from a good spreading of a liquid composition over the surface when the surface is treated therewith and from the reduced formation of watermarks and reduced precipitation of poorly water soluble salts when water evaporates. The ability of a composition to provide "shine" to the surface refers to the composition's ability to leave no watermarks after evaporation of water. This can be evaluated by human visual grading.

In a suitable test method a composition according to the present invention and a reference composition are applied (about 3 grams of each product) with a SPONTEX® sponge on two rectangular areas (20 cm×20 cm) of a surface made of stainless steel or ceramic. Each surface is wiped (16 strokes) by using the SPONTEX® sponge with the product. Then each treated surface is rinsed with 50 ml of tap water and left to dry. Items are observed during the drying phase in a way to evaluate water spreading/slipping on the treated surface. After the surfaces treated with the compositions according to the present invention and those treated with the reference composition are dried, they are compared side by side and evaluated by visual grading to evaluate shine difference. Evaluation may be generally done by applying the Panel Score Unit (PSU). Shine result is expressed reporting whether the effect of water spreading/slipping is present and the final PSU evaluation.

In a long lasting shine test method, the test method as mentioned above may be carried out, but the rinsing and drying cycles are repeated several times. Each time, after both the surfaces are dried they are compared side by side and evaluated by visual grading to see shine difference. Evaluation is generally done by applying the Panel Score Unit (PSU).

EXAMPLES

These compositions were made comprising the listed ingredients in the listed proportions (weight %).

| Ingredients: (% by weight) | I | II | III | IV | V | VI | VII | VIII | IX |
|---|---|---|---|---|---|---|---|---|---|
| DOBANOL ® 91-8 | 1.3 | 1.5 | 1.5 | 3.5 | 3.5 | 10.0 | 1.5 | 3.5 | 2.5 |
| n-BPP ® | 2.0 | 2.0 | 2.0 | — | 2.0 | 2.0 | 2.0 | — | 3.0 |
| Citric Acid | 3.5 | 3.5 | 3.0 | 3.5 | 3.5 | 3.5 | — | — | — |
| Maleic Acid | — | — | — | — | — | — | — | — | 2.5 |
| LUVISKOL K60 ® | 0.1 | 0.1 | 0.05 | 0.05 | 0.1 | 0.1 | 0.1 | 0.05 | 0.15 |
| KELZAN T ® | 0.3 | 0.6 | 0.2 | 0.3 | 0.3 | 0.3 | 0.3 | 0.3 | 0.2 |
| NaOH | 1.5 | 1.5 | 1.25 | 1.5 | 1.5 | 1.5 | 0.2 | 0.3 | 1.2 |
| Waters & Minors | | | | | up to 100 | | | | |

The pH of these examples is 7 or above.

| Ingredients: (% by weight) | X | XI | XII | XIII | XIV | XV | XVI | XVII | XVIII |
|---|---|---|---|---|---|---|---|---|---|
| LUTENSOL ® AO 30 | 1.3 | 1.5 | 1.75 | 3.5 | 3.5 | 10.0 | 1.8 | 2.5 | 3.5 |
| n-BPP ® | 2.0 | 2.0 | 2.0 | — | 2.0 | 2.0 | 2.0 | — | 5.0 |
| Citric Acid | 3.5 | 3.5 | 3.0 | 3.5 | 3.5 | 3.5 | — | | |
| Maleic Acid | — | — | — | — | — | — | — | — | 2.5 |
| LUVISKOL K60 ® | 0.1 | 0.1 | 0.05 | 0.05 | 0.1 | 0.1 | 0.1 | 0.05 | 0.15 |
| KELZAN T ® | 0.3 | 0.6 | 0.2 | 0.3 | 0.3 | 0.3 | 0.3 | 0.3 | 0.2 |
| NaOH | 1.5 | 1.5 | 1.25 | 1.5 | 1.5 | 1.5 | 0.2 | 0.3 | 1.2 |
| Waters & Minors | | | | | up to 100 | | | | |

The pH of these examples is 7 or above.

KELZAN T® is a Xanthan gum supplied by Kelco.

LUVISKOL K60® is a Polyvinylpyrrolidone supplied by BASE.

n-BPP® is butoxy propoxy propanol commercially available from Dow Chemical.

DOBANOLS® 91-8 is a $C_9$–$C_{11}$ ethoxylated alcohol commercially available from Shell.

LUTENSOLS® AO 30 is a $C_{12-14}$ ethoxylated alcohol commercially available from BASE.

What is claimed is:

1. A liquid composition, having a pH of from 7 to 14, comprising a nonionic surfactant, a copolymer of N-vinylpyrrolidone and an alkylenically unsaturated monomer, and a polysaccharide polymer, wherein the composition is essentially free of any amphoteric surfactant.

2. A composition according to claim 1, wherein the nonionic surfactant is selected from the group consisting of polyethylene oxide condensates of alkyl phenols, polyethylene oxide condensates of alkyl alcohols, alkylpolysaccharides, and mixtures thereof.

3. A composition according to claim 1, wherein the nonionic surfactant is selected from the group consisting of a $C_6$–$C_{20}$ alkyl phenol ethoxylate having from 3 to 25 ethoxy groups, a $C_2$–$C_{24}$ alcohol ethoxylate having from 2 to 35 ethoxy groups, or a mixture thereof.

4. A composition according to claim 1, wherein the composition comprises from 0.1% to 20% by weigh of the total composition, of a nonionic surfactant.

5. A composition according to claim 1, wherein the alkylenically unsaturated monomer is selected from the group consisting of maleic acid, chloromaleic acid, fumaric acid, itaconic acid, citraconic acid, phenylmaleic acid, aconitic acid, acrylic acid, N-vinylimidazole, vinyl acetate, anhydrides of vinyl acetate, styrene, sulphonated styrene, alpha-methyl styrene, vinyl toluene, t-butyl styrene and mixtures thereof.

6. A composition according to claim 1 wherein the vinylpyrrolidone copolymer is a quaternized or unquaternized vinylpyrrolidone/dialkylaminoalkyl acrylate or methacrylate copolymer having the following formula:

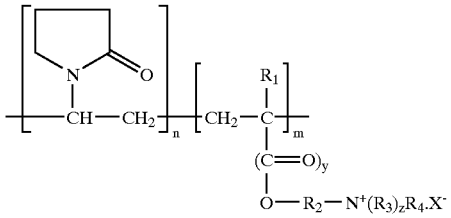

in which n is between 20 and 99 mol % and m is between 1 and 80 mol %; $R_1$ represents H or $CH_3$; y denotes 0 or 1; z denotes 1 or 2; $R_2$ is —$CH_2$—CHOH—$CH_2$— or $C_xH_{2x}$, in which x=2 to 18; $R_3$ represents a lower alkyl group of from 1 to 4 carbon atoms, or

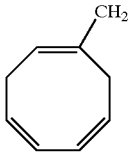

$R_4$ denotes a lower alkyl group of from 1 to 4 carbon atoms; and $X^-$ is chosen from the group consisting of Cl, Br, I, ½$SO_4$, $HSO_4$ and $CH_3SO_3$.

7. A composition according to claim 1, which comprises from 0.01% to 5% by weight of the total composition of a vinylpyrrolidone homopolymer or copolymer.

8. A composition according to claim 1, wherein said polysaccharide polymer is a substituted cellulose material or a naturally occurring polysaccharide polymer.

9. A composition according to claim 1, wherein said polysaccharide polymer is carboxymethylcellulose, ethyl cellulose, hydroxyethyl cellulose, hydroxypropyl cellulose, hydroxymethyl cellulose, succinoglycan, xanthan gum, guar gum, locust bean gum, tragacanth gum, derivatives of tragacanth gum, or mixtures thereof.

10. A composition according to claim 1, which comprises from 0.01% to 5% by weight of the total composition of a polysaccharide polymer.

11. A composition according to claims 1, which further comprises a source of alkalinity.

12. A composition according to claims 1, which further comprises a solvent.

13. A composition according to claim 12, wherein said composition comprises from 0.1% to 8% by weight of the total composition of said solvent.

14. A composition according to claim 1, wherein said composition further comprises one or more ingredients selected from the group consisting of cationic surfactants, anionic surfactants, zwitterionic surfactants, radical scavengers, preservatives, chelating agents, acids, perfumes, dyes, bleaches and bleach activators.

15. The composition according to claim 6 wherein n is between 40 and 90 mol %.

16. The composition according to claim 6 wherein m is between 5 and 40 mol %.

17. A composition according to claim 1, wherein the vinylpyrrolidone copolymer is an unquaternized vinylpyrrolidone/dialkylaminoalkyl acrylate or methacrylate copolymer.

18. A process of treating a hard-surface by applying a liquid composition according to claim 1 onto said surface.

19. A process for treating a hard surface to provide a shine benefit and/or to provide a long-lasting shine benefit to the hard surface, the process comprising: applying a composition comprising at least one nonionic surfactant, a copolymer of vinypyrrolidone and an alkylenically unsaturated monomer, and a polysaccharide polymer, to the hard surface.

20. A process for treating a hard surface to reduce the formation of limescale deposits and/or watermarks on the hard surface, the process comprising: applying a composition comprising at least one nonionic surfactant, a copolymer of vinypyrrolidone and an alkylenically unsaturated monomer, and a polysaccharide polymer, to the hard surface.

21. A process for treating a hard surface to provide a "next-time" cleaning benefit to the surface, the process comprising: applying a composition comprising at least one nonionic surfactant, a copolymer of vinypyrrolidone and an alkylenically unsaturated monomer, and a polysaccharide polymer, to the hard surface.

* * * * *